US007785148B2

(12) United States Patent
Pan

(10) Patent No.: US 7,785,148 B2
(45) Date of Patent: Aug. 31, 2010

(54) HIGH SPEED ELECTRICAL CONNECTOR HAVING IMPROVED SHIELD

(75) Inventor: Feng Pan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,863

(22) Filed: Dec. 29, 2008

(65) Prior Publication Data

US 2009/0170373 A1 Jul. 2, 2009

(30) Foreign Application Priority Data

Dec. 29, 2007 (CN) ..... 2007 1 0302596

(51) Int. Cl.
*H01R 13/648* (2006.01)

(52) U.S. Cl. ..... 439/607.06

(58) Field of Classification Search ..... 439/607.06, 439/607.07, 607.1
See application file for complete search history.

(56) References Cited

U.S. PATENT DOCUMENTS

| | | | | |
|---|---|---|---|---|
| 4,846,727 | A | 7/1989 | Glover et al. | |
| 6,354,877 | B1 | 3/2002 | Shuey et al. | |
| 6,435,913 | B1 * | 8/2002 | Billman | 439/607.1 |
| 6,602,095 | B2 | 8/2003 | Astbury, Jr. et al. | |
| 6,764,342 | B2 * | 7/2004 | Murayama et al. | 439/607.1 |
| 6,872,085 | B1 | 3/2005 | Cohen et al. | |
| 6,899,566 | B2 | 5/2005 | Kline et al. | |
| 6,979,226 | B2 * | 12/2005 | Otsu et al. | 439/607.07 |

* cited by examiner

*Primary Examiner*—Truc T Nguyen
(74) *Attorney, Agent, or Firm*—Ming Chieh Chang; Wei Te Chung; Andrew C. Cheng

(57) ABSTRACT

An electrical connector (1, 1', 1") includes an insulative housing (10, 10', 10"), an array of first shielding plates (30, 30', 30") retained in the insulative housing in parallel arrangement, and an array of second shielding plates (40, 40', 40") retained in the insulative housing and arranged perpendicularly to the first shielding plates. Each second shielding plate includes a strip-shaped base portion (41, 41', 41") electrically connected to the first shielding plates.

20 Claims, 11 Drawing Sheets

HIGH SPEED ELECTRICAL CONNECTOR HAVING IMPROVED SHIELD

BACKGROUND OF THE INVENTION

1. Field of the Invention

The present invention relates to a high speed connector, and particularly to a high speed electrical connector which is provided with an improved shield.

2. Description of Related Arts

Generally, the high speed connector typically has a large number of contacts electrically connected to a printed circuit board for transmitting high speed signals or data. Such a conventional high speed connector is disclosed in U.S. Pat. No. 6,899,566 issued on May 31, 2003. The electrical connector has an insulative housing, rows and columns of contact pairs fastened to the insulative housing, and an array of shielding plates retained in the insulative housing for providing Electro Magnetic Interference (EMI) shielding for the contact pairs.

However, the shielding plates of the conventional connector are not firmly fixed in the insulative housing. When used in a very high speed environment, the conventional connector cannot provide a even better EMI effect.

Hence, a high speed electrical connector with improved shielding plates is desired.

SUMMARY OF THE INVENTION

An object of the present invention is to provide an electrical connector having improved shielding plates connected together for providing an effectual EMI shielding between adjacent contact pairs.

To achieve the above object, an electrical connector includes an insulative housing with a plurality of contacts received therein, an array of first shielding plates retained in the insulative housing in parallel arrangement, and an array of second shielding plates retained in the insulative housing and arranged perpendicularly to the first shielding plates. Each second shielding plate includes a strip-shaped base portion electrically connected with the first shielding plates.

Advantages of the present invention are to provide an electrical connector has an array of first shielding plates, and an array of second shielding plates connected with the first shielding plates together for firmly fixing in the insulative housing. Thus, an effectual EMI shielding between adjacent contact pairs is provided.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
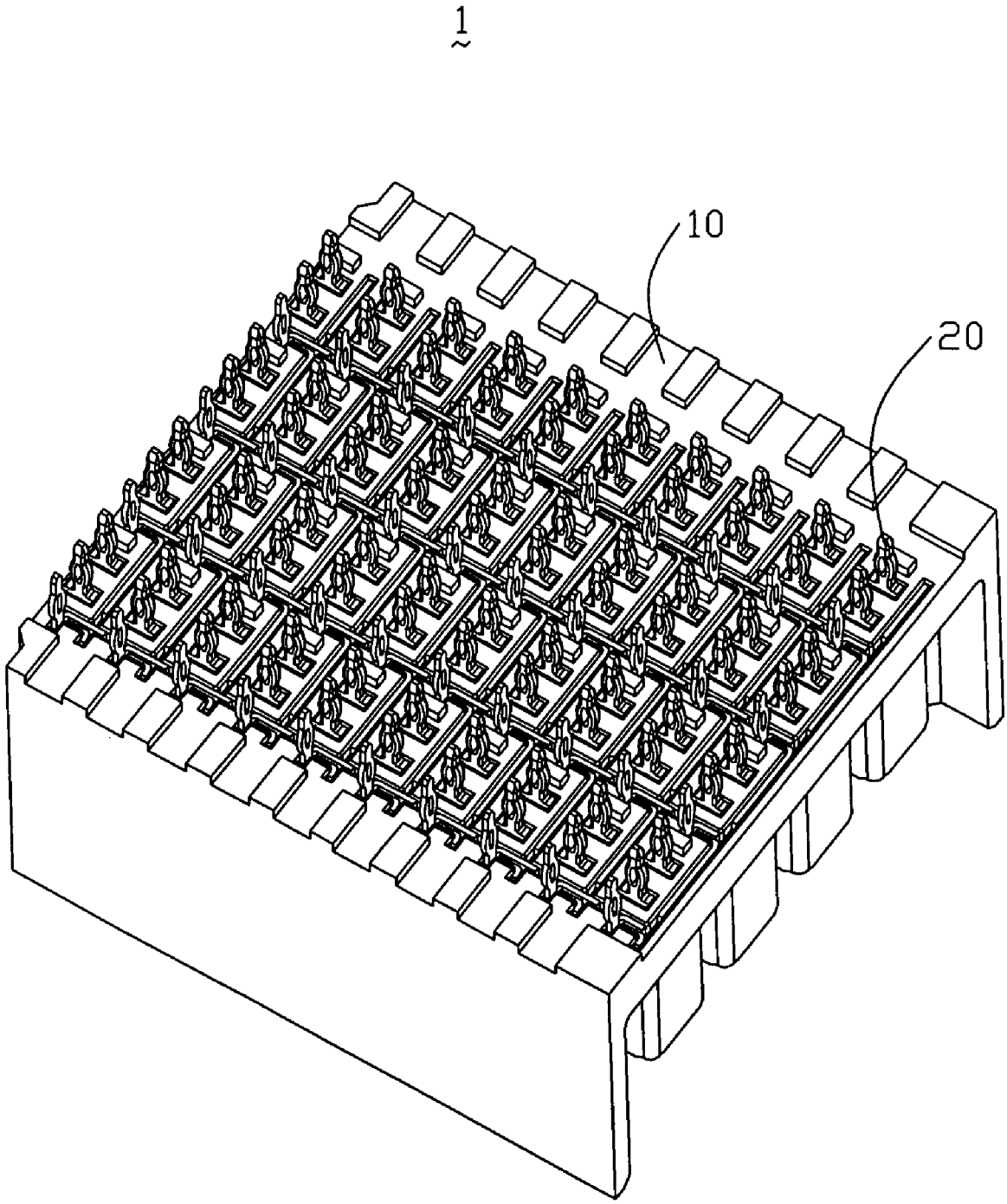
FIG. 1 is an assembled perspective view of an electrical connector in accordance with a first embodiment of the present invention.

Reference will now be made to the drawing figures to describe the present invention in detail. Referring to FIGS. 1-4, an electrical connector 1 in accordance with a first embodiment of the present invention includes an insulative housing 10, a number of contacts 20 fastened to the insulative housing 10, an array of first shielding plates 30 and an array of second shielding plates 40 retained in the insulative housing 10.

Figure 2:
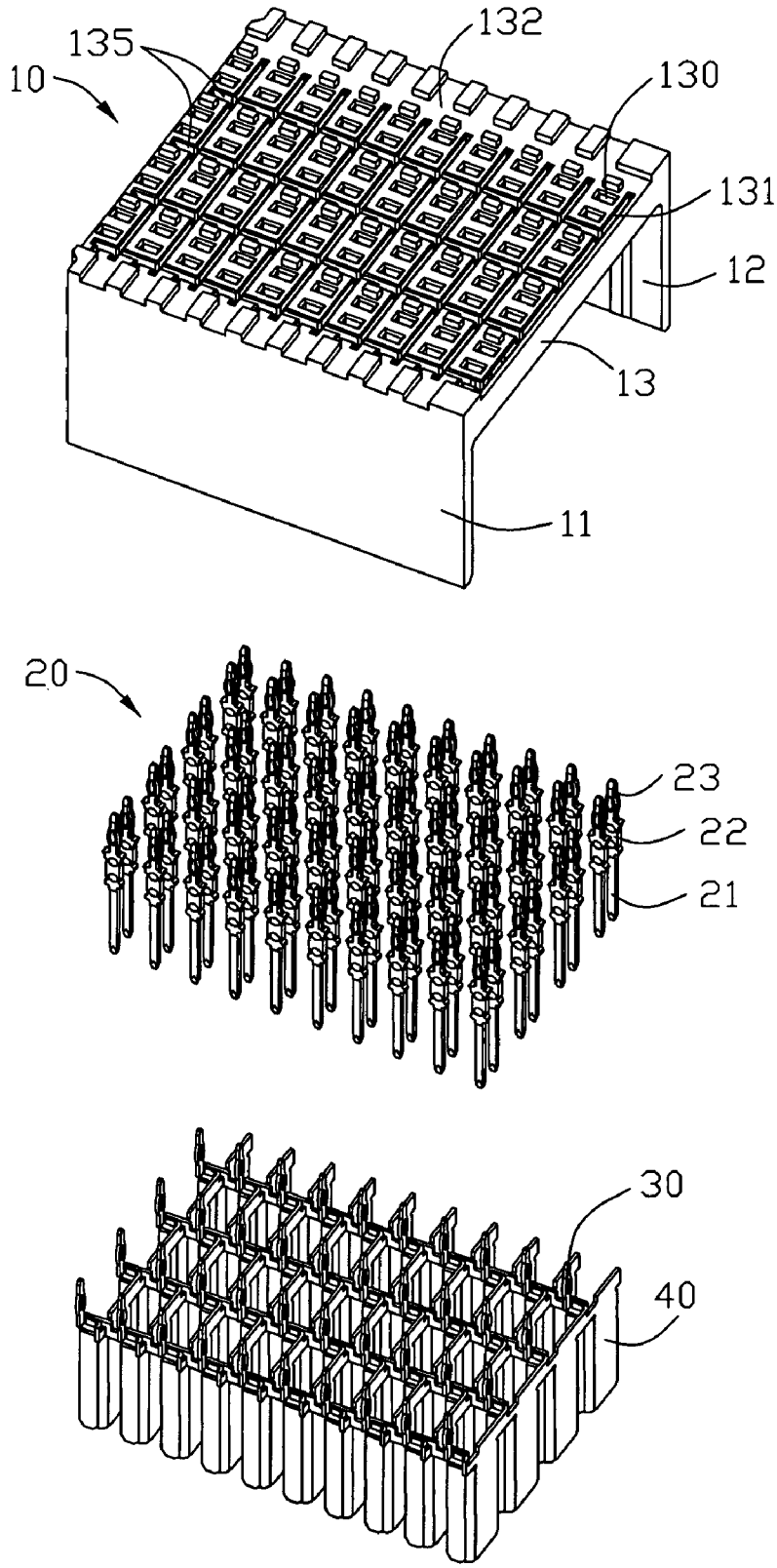
FIG. 2 is an exploded perspective view of the electrical connector as shown in FIG. 1.
Figure 3:
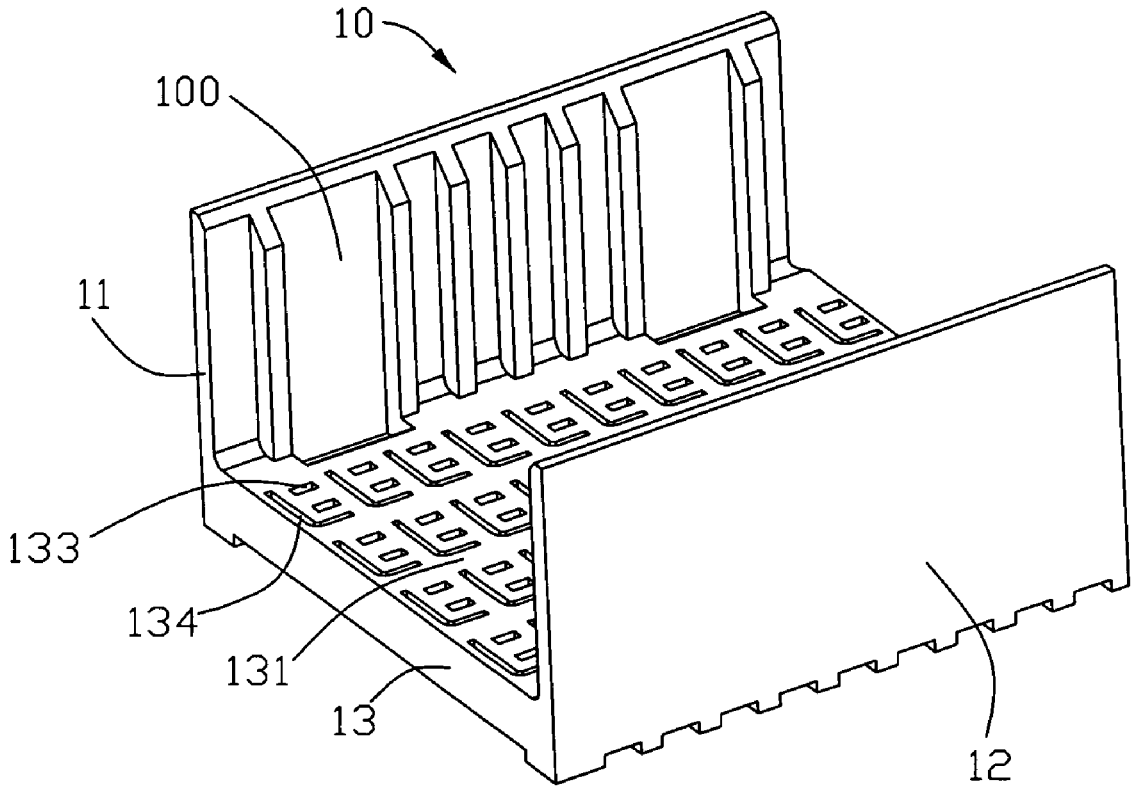
FIG. 3 is a perspective view of an insulative housing of the electrical connector as shown in FIG. 1.

Referring to FIGS. 1-3, the insulative housing 10 has two opposite lateral walls 11, 12, a bottom wall 13 and a receiving cavity 100 defined therebetween for receiving a complementary connector (not shown). The bottom wall 13 has a mating face 131 formed in the receiving cavity 100, and a mounting face 132 formed opposite to the mating face 131 for mounting on a printed circuit board (not shown). The bottom wall 13 has a number of contact-receiving holes 133 extending through the mating face 131 and the mounting face 132. The contact-receiving holes 133 are arranged in pairs in order to fasten corresponding pairs of the contacts 20.

The bottom wall 13 has a number of L-shaped openings 134 extending through the mating face 131 and the mounting face 132. Each L-shaped opening 134 partially surrounds a corresponding pair of the contact-receiving holes 133 for retaining the first shielding plate 30. The L-shaped openings 134 are arranged in rows and columns to defining a pattern or matrix corresponding to the contact-receiving holes 133. So that each pair of contact-receiving openings 133 is isolated from adjacent pairs. The bottom wall 13 also has an array of passages 135 defined on the mounting face 132 for insertion of the second shielding plates 40. The passage 135 and the L-shaped opening 134 are partially communicated with each other.

The contacts 20 are arranged in a pattern of contact pairs that aligned in rows and columns. Each contact 20 has a mating portion 21 disposed in the receiving cavity 100 of the insulative housing 10 for electrically contacting with the complementary connector, a fastening portion 22 interconnected with the mating portion 21 and fastened in the contact-receiving hole 133, and a connecting portion 23 connected to the printed circuit board.

Figure 4:
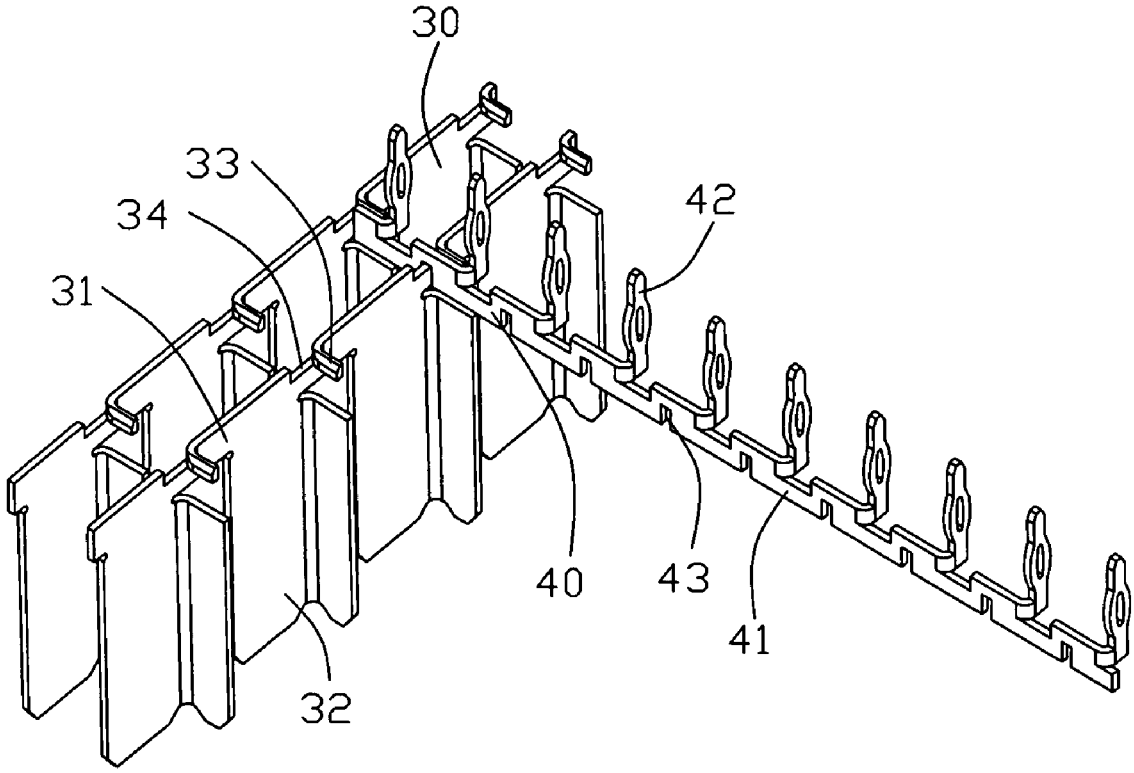
FIG. 4 is an assembled perspective view showing two first shielding plates connected with a second shielding plate of the electrical connector as shown in FIG. 2.

Referring to FIG. 4, the first shielding plates 30 are retained in the L-shaped openings 134. Each first shielding plate 30 has a strip portion 31 and a number of L-shaped plates 32 disposed on a lower edge of the strip portion 31. Each L-shaped plate 32 partially surrounds a contact pair of the contacts 20 in the receiving cavity 100 for isolating the contact pair from adjacent pair. The first shielding plate 30 also has a number of elastic plates 33 formed on an upper edge of the strip portion 31. Each elastic plate 33 extends along a direction perpendicular to that of the strip portion 31, and the elastic plate 33 is inserted in the passage 135. The first shielding plates 30 are configured to partially enclose each contact pair of the contacts 20. Each pair of the contacts 20 is substantially surrounded by the first shielding plates 30.

The second shielding plates 40 are arranged perpendicular to the first shielding plates 30. Each second shielding plate 40 has a strip-shaped base portion 41, a number of grounding tails 42 formed on an upper edge of the base portion 41. The base portion 41 is inserted in the passage 135 of the insulative housing 10 and contacted with the elastic plate 33 of the first shielding plate 30. The grounding tails 42 are arranged along a lateral side of the base portion 41. Each grounding tail 42 has a bending portion 421 connected with the base portion 41. Thus, the grounding tail 42 and the connecting portions 23 of the adjacent contacts 20 are preferably arranged in a row. The grounding tails 42 are connected with grounding traces of the printed circuit board. The second shielding plate 40 also has a number of gaps 43 defined on a lower edge of the base portion 41 for insertion of the first shielding plates 30. Thus, a reliable connection is established between the first shielding plate 30 and the second shielding plate 40. The first shielding plate 30 is electrically connected with the printed circuit board via the grounding tails 42 of the second shielding plate 40.

Figure 5:
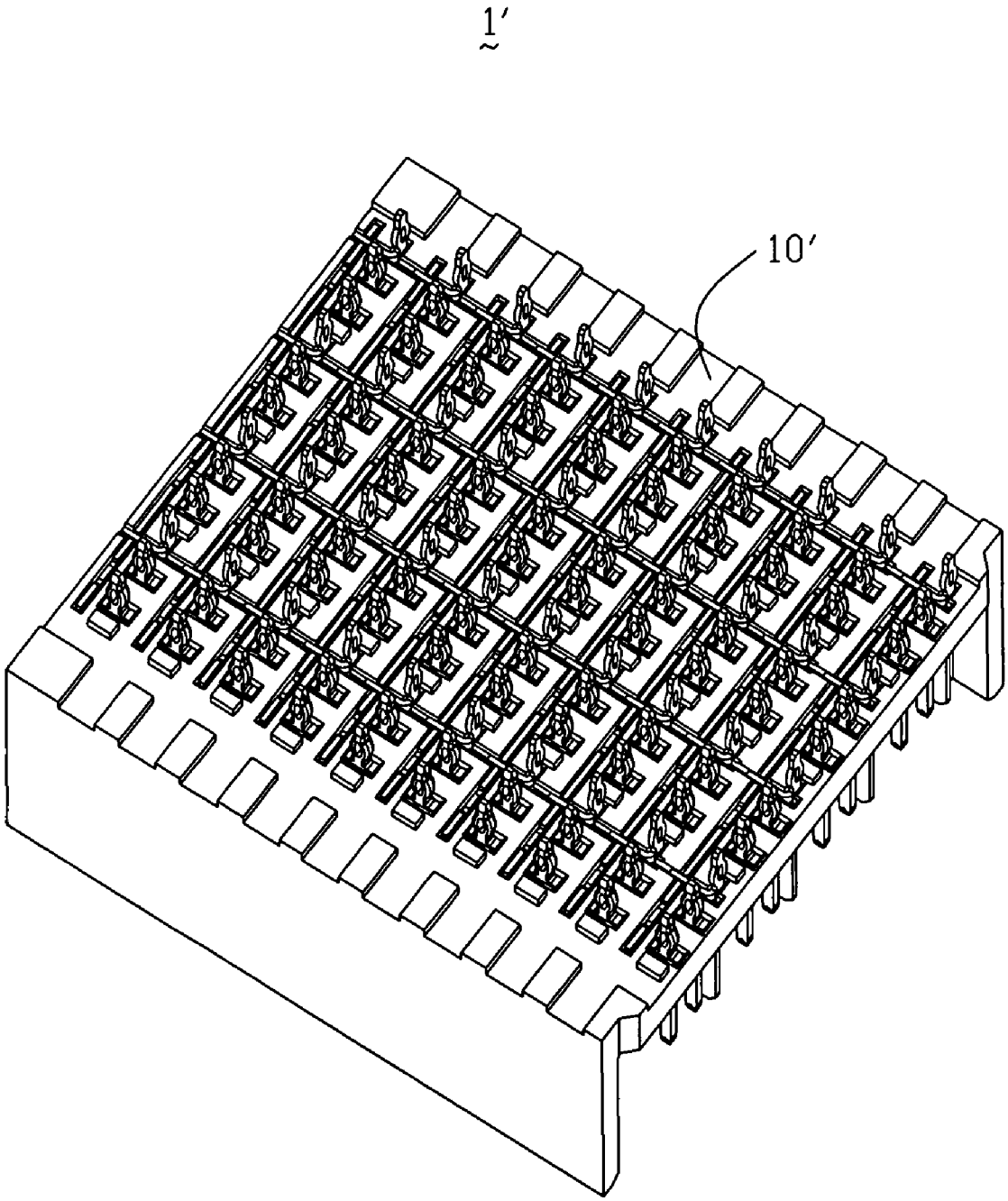
FIG. 5 is an assembled perspective view of an electrical connector in accordance with a second embodiment of the present invention.
Figure 6:
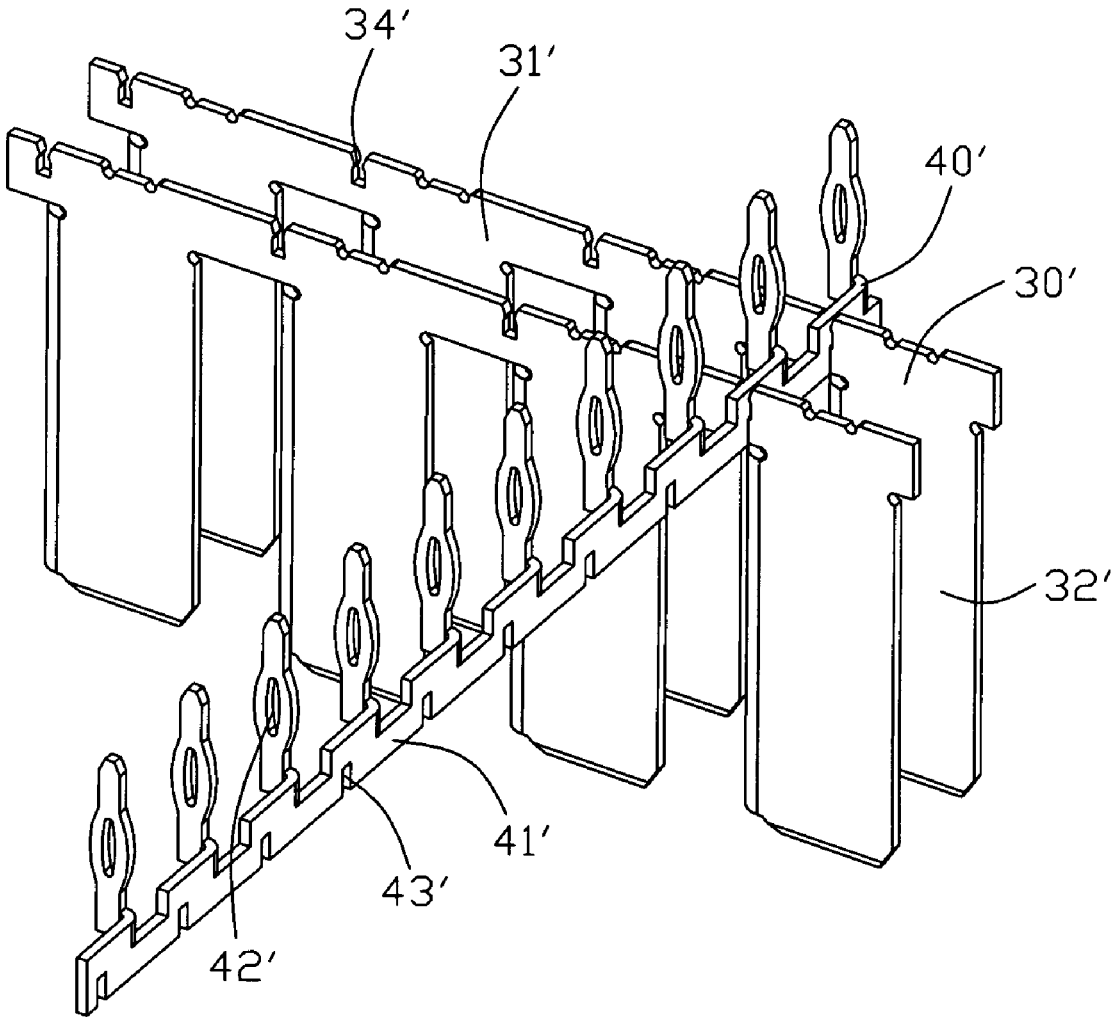
FIG. 6 is an assembled perspective view showing two first shielding plates connected with a second shielding plate of the electrical connector as shown in FIG. 5.

Referring to FIGS. 5 and 6, an electrical connector 1' in accordance with a second embodiment of the present invention includes an insulative housing 10', an array of first shielding plates 30' and an array of second shielding plates 40' retained in the insulative housing 10'. Each first shielding plate 30' has a strip portion 31', a number of L-shaped plates 32' disposed on an edge of the strip portion 31', and a number of gaps 34' defined on an opposite edge of the strip portion 31' for insertion of the second shielding plates 40'. The second shielding plates 40' are arranged perpendicular to the first shielding plates 30'. Each second shielding plate 40' has a strip-shaped base portion 41', a number of grounding tails 42' are formed along a lateral side of the base portion 41', and a number of gaps 43' defined on an opposite edge of the base portion 41' for insertion of the first shielding plates 30'. The first shielding plate 30' is electrically connected with the printed circuit board via the grounding tails 42' of the second shielding plate 40'.

Figure 7:
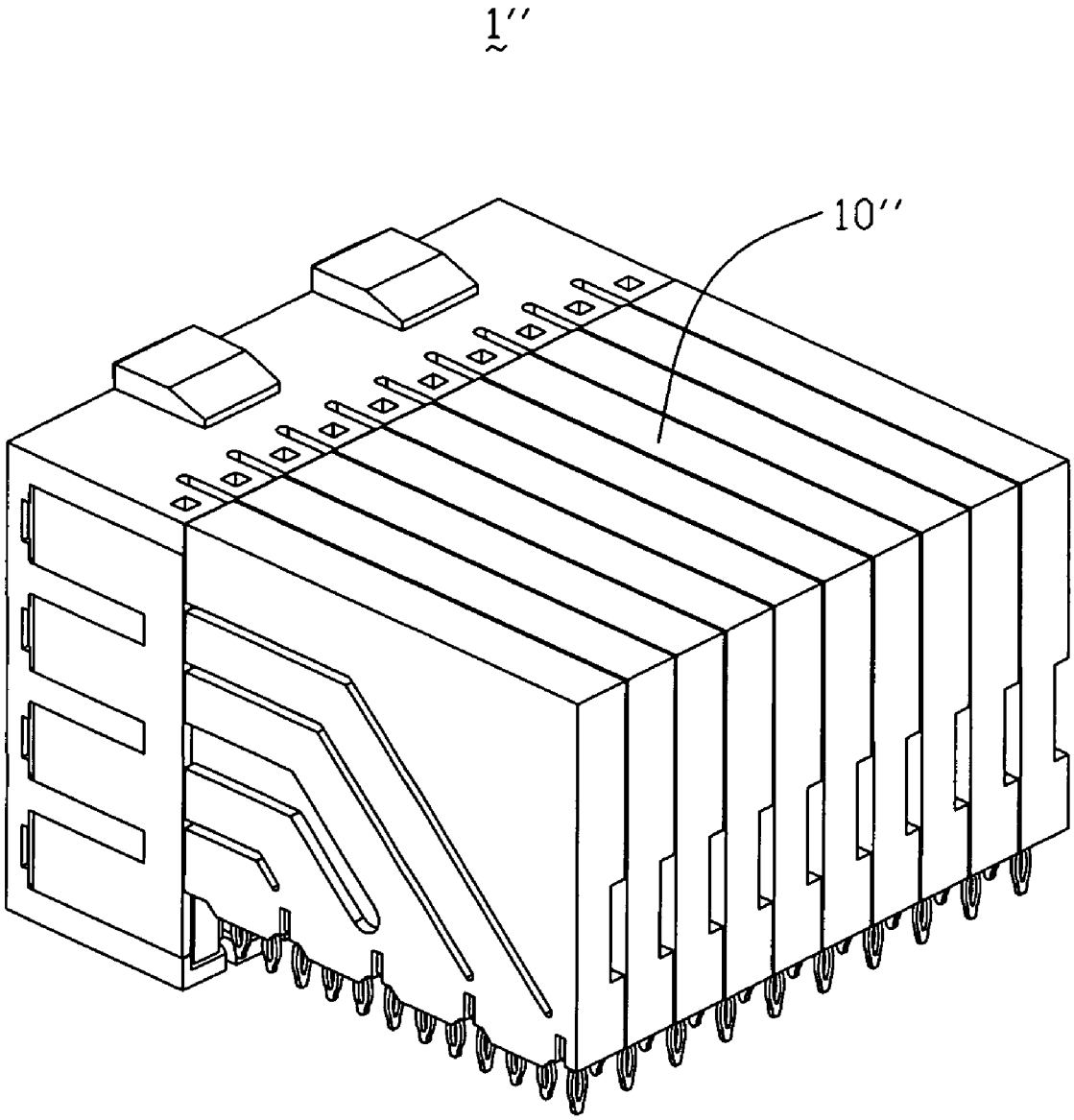
FIG. 7 is an assembled perspective view of an electrical connector in accordance with a third embodiment of the present invention.
Figure 8:
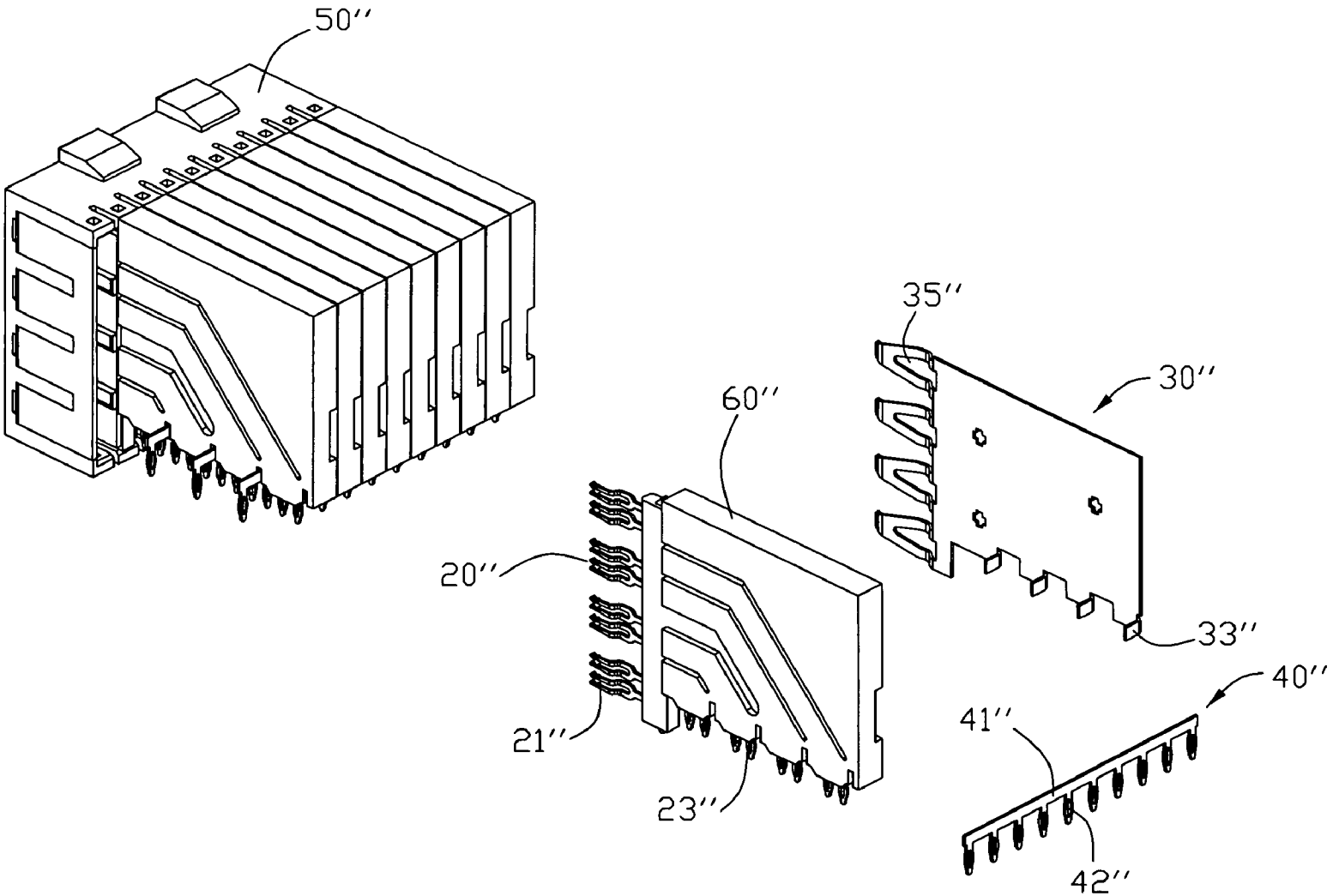
FIG. 8 is an exploded perspective view of a wafer, a first shielding plate and a second shielding plate of the electrical connector as shown in FIG. 7.
Figure 9:
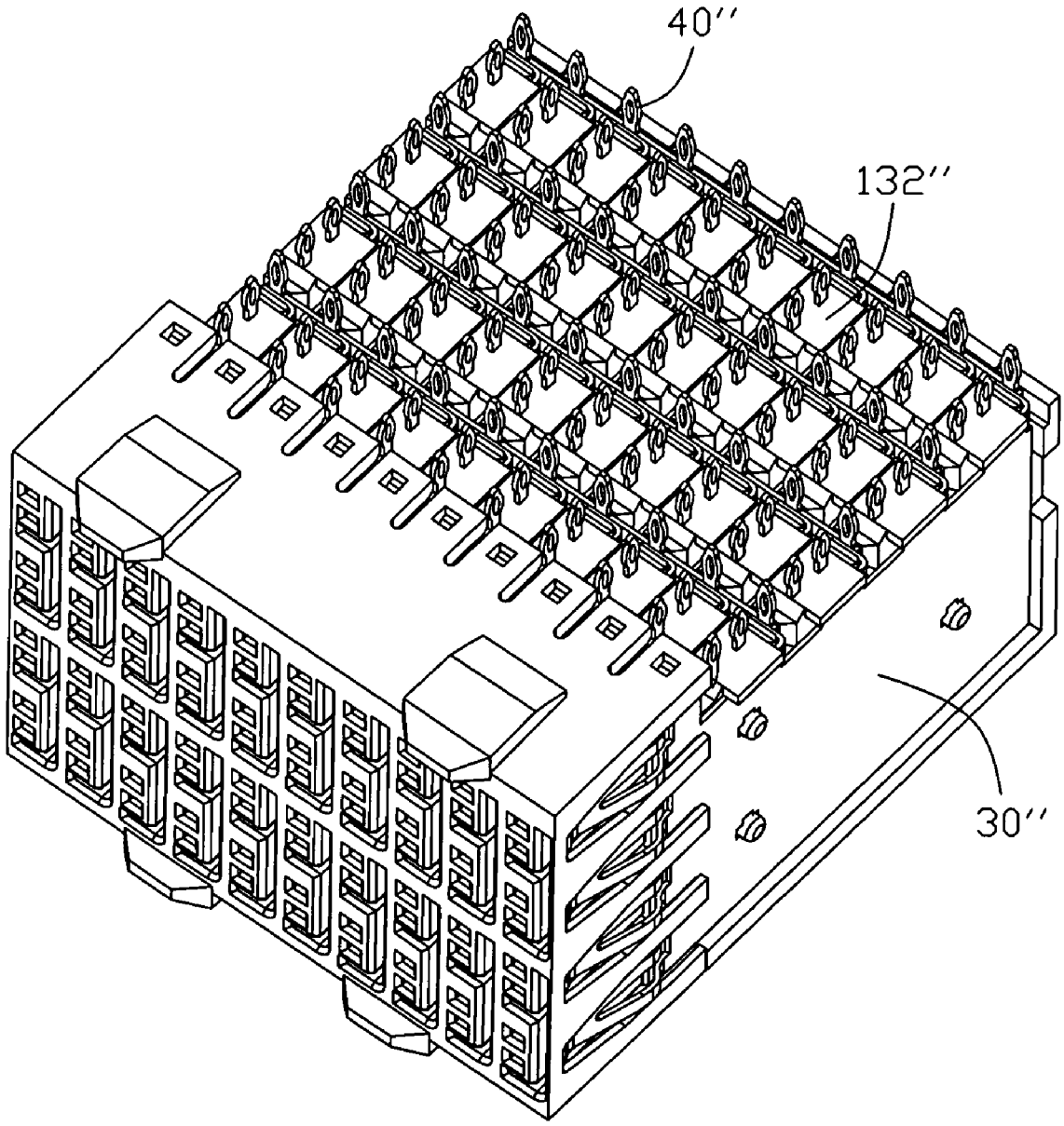
FIG. 9 is another assembled perspective view similar to FIG. 7 taken from another aspect.

Referring to FIGS. 7-8, an electrical connector 1" in accordance with a third embodiment of the present invention includes an insulative housing 10", a number of contacts 20", and a number of first and second shielding plates 30", 40" retained in the insulative housing 10".

Referring to FIGS. 8-11, the insulative housing 10" includes a front housing 50" and a number of wafers 60" mounted on the front housing 50" in side-by-side arrangement. Each wafer 60" has a receiving portion 134" formed in a lateral surface thereof for receiving the first shielding plate 30". The wafer 60" has a number of fastening posts 61" formed in the receiving portion 134" for fastening the first shielding plate 30". The wafer 60" also has a mounting face 132" on a lower edge defining a number of passages 135" for retaining the second shielding plates 40".

The contacts 20" are over-molded in the wafer 60" and arranged in a pattern of contact pairs. Each contact 20" has a pair of contact portions 21", 23" located at opposite ends, and an interim section (not shown) interconnected with the pair of contact portions 21", 23".

Figure 10:
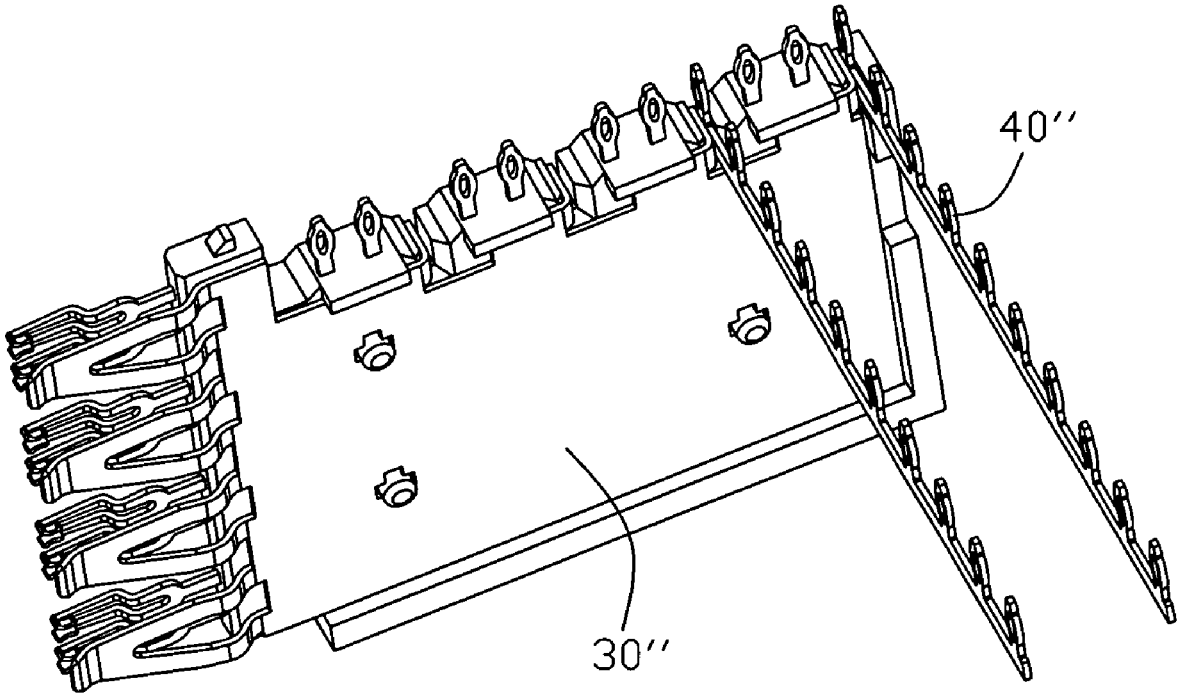
FIG. 10 is an assembled perspective view of a first and a second shielding plate mounted on a wafer of the electrical connector as shown in FIG. 7.
Figure 11:
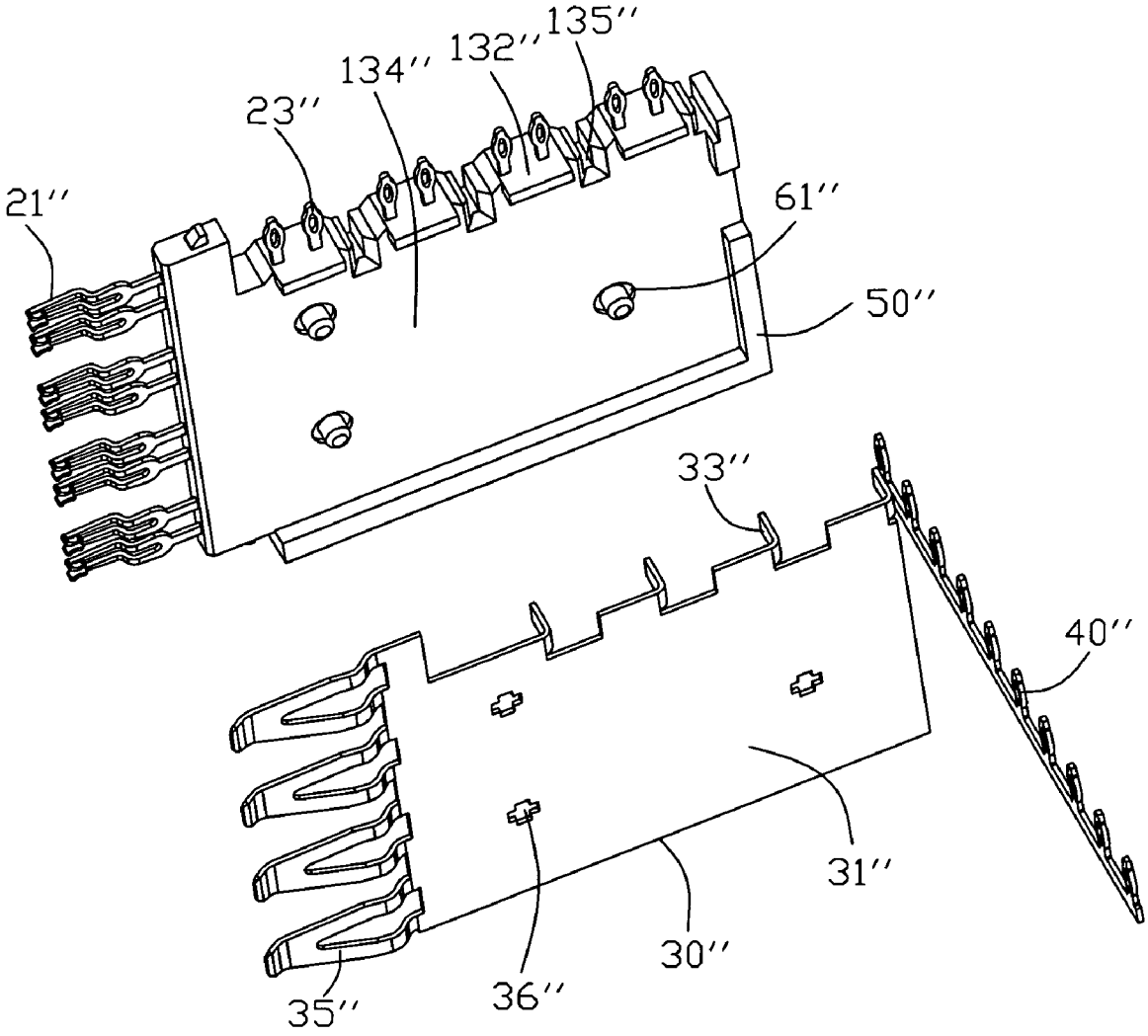
FIG. 11 is another assembled perspective view showing an assembled first and second shielding plate not mounted on the wafer as shown in FIG. 10.

Referring to FIGS. 10 and 11, the first shielding plate 30" is fastened in the receiving portion 134". The first shielding plate 30" has a main body 31" having a front edge and a bottom edge, a number of grounding contacts 35" formed on the front edge, and a plurality of elastic plates 33" formed on the bottom edge and protruding into the passage 135". The first shielding plate 30" also has a number of holes 36" for coupling with the fastening post 61".

Referring to FIG. 8, the second shielding plate 40" has a strip-shaped base portion 41", a number of grounding tails 42" formed on an edge of the base portion 41". The grounding tail 42" is coplanar with the base portion 41". The base portion 41" is inserted in the passage 135" and contacted with the elastic plate 33" of the first shielding plate 30". The first shielding plate 30" is electrically connected with the printed circuit board via the grounding tails 42" of the second shielding plate 40".

The first shielding plates 30, 30', 30" and the second shielding plates 40, 40', 40" are connected together for firmly fixing in the insulative housing 10, 10', 10". Thus, an effectual EMI shielding between adjacent contact pairs is provided.

Other objects, advantages and novel features of the invention will become more apparent from the following detailed description of a preferred embodiment when taken in conjunction with the accompanying drawings.

What is claimed is:

1. An electrical connector comprising:

an insulative housing with a plurality of contacts received therein, said insulative housing defining a boundary;

an array of first shielding plates retained in the insulative housing in parallel arrangement; and an array of second shielding plates retained in the insulative housing and arranged orthogonally to the first shielding plates, each second shielding plate comprising a strip-shaped base portion electrically connected to the first shielding plates, wherein said first shielding plate and the second shielding plate extend toward opposite directions, with respect to the boundary, corresponding to the contacts at opposite sides of the boundary, respectively.

2. The electrical connector as claimed in claim 1, wherein said insulative housing has a mounting face formed at the boundary, said mounting face defining a plurality of passages for retaining the base portions of the second shielding plates.

3. The electrical connector as claimed in claim 1, further comprising a plurality of pairs of contacts fastened to the insulative housing; wherein each first shielding plate has a plurality of L-shaped plates, each L-shaped plate partially surrounding a contact pair.

4. The electrical connector as claimed in claim 1, wherein said insulative housing has a front housing and a plurality of wafers disposed in the front housing in side-by-side arrangement, and wherein each wafer has a receiving portion defined on a lateral surface for receiving the first shielding plate, said wafer having a lower surface formed at the boundary and a plurality of passages defined on the lower surface for receiving the base portion of the second shielding plate.

5. The electrical connector as claimed in claim 1, wherein said contact comprising a mating portion and a connecting portion located at opposite sides of the boundary, said first shielding plate having a dimension corresponding to that of the mating portion of the contact for shielding the mating portion, while said second shielding plate being substantially flush with the connecting portions of the contacts for grounding.

6. The electrical connector as claimed in claim 2, wherein each first shielding plate has at least an elastic plate inserted into the passage of the insulative housing for connecting with the base portion of the second shielding plate.

7. The electrical connector as claimed in claim 2, wherein said second shielding plate has a plurality of gaps defined on the base portion.

8. The electrical connector as claimed in claim 7, wherein each first shielding plate has a plurality of gaps.

9. The electrical connector as claimed in claim 1, wherein said second shielding plate has a plurality of grounding tails bent laterally from the base portion for electrically connecting with a printed circuit board.

10. The electrical connector as claimed in claim 9, wherein each grounding tail has a bending portion ripping off and bent from an inner portion of the base portion of the second shielding plate.

11. The electrical connector as claimed in claim 9, wherein said grounding tails of the second shielding plates are coplanar with the base portion thereof.

12. The electrical connector as claimed in claim 4, further comprising a plurality of pairs of contacts received in the wafer, wherein each first shielding plate has a main body having a front edge and a bottom edge, a plurality of grounding contacts formed on the front edge, and a plurality of elastic plates formed on the bottom edge and inserted into the passage of the wafer for electrically connecting with the base portion of the second shielding plate.

13. An electrical connector comprising:

insulative housing sub-assembly;

a plurality of differential pair signal contacts arranged in matrix in said housing sub-assembly; and a plurality of grounding bars in rows and columns, being interwoven with one another in grids, each of said grids enclosing a corresponding differential pair signal contacts; wherein the grounding bars of rows, which extend along a row direction, are equipped with tails, wherein the tails of the grounding bar are aligned respectively with tails of the differential pair contacts in a column direction perpendicular to the row direction.

14. The electrical connector as claimed in claim 13, wherein the tails of the grounding bar lies in a first plane while the tails of the corresponding signal contact in the same row lies in a second plane perpendicular to said first plane.

15. The electrical connector as claimed in claim 14, wherein each of the grounding bars of columns, which extends in a column direction perpendicular to the row direction, defines a plurality of first blades extending in the row direction parallel to the first plane.

16. The electrical connector as claimed in claim 15, wherein each of said first blades essentially intimately supportably abuts against one corresponding grounding bar of rows in the column direction.

17. The electrical connector as claimed in claim 16, wherein each of said grounding bars of columns further includes a plurality of second blades extending in the row direction, and each of said second blades cooperates with the corresponding first blade to retain the corresponding grounding bar of rows therebetween in the column direction.

18. The electrical connector as claimed in claim 16, wherein said each of the grounding bars of columns is dimensioned with a similar height with regard to the signal contacts along a vertical direction perpendicular to both said column direction and said row direction, so as to essentially shield the corresponding signal contacts horizontally, while the grounding bars of rows are essentially only located at bottom portions of the grounding bars of columns with thereof the tails connecting to a printed circuit board.

19. An electrical connector comprising:

insulative housing sub-assembly;

a plurality of wafers side by side stacked upon one another, each of said wafers including a plurality of differential pair signal contacts; and a plurality of grounding bars in rows and columns, being interwoven with one another in grids, each of said grids enclosing a corresponding differential pair signal contacts; wherein the grounding bars of rows, which extend along a row direction, are equipped with tails; wherein the tails of each corresponding grounding bar are aligned respectively with tails of the differential pair contacts in a column direction perpendicular to said row direction; wherein the grounding bars of columns respectively covering side faces of corresponding wafers to isolate signal contacts of different wafers from each other in the row direction.

20. The electrical connector as claimed in claim 19, wherein each of the grounding bars of columns further includes a plurality of blades each extending in the row direction to abut against one corresponding grounding bar of rows in said column direction.

* * * * *